US009620277B2

(12) United States Patent
Grubl et al.

(10) Patent No.: US 9,620,277 B2
(45) Date of Patent: Apr. 11, 2017

(54) CORE BODY OF FERROMAGNETIC MATERIAL, MAGNETIC CORE FOR AN INDUCTIVE COMPONENT AND METHOD OF FORMING A MAGNETIC CORE

(71) Applicant: SUMIDA Components & Modules GmbH, Obernzell (DE)

(72) Inventors: Martin Grubl, Untergriesbach (DE); Helmut Rott, Thyrnau (DE)

(73) Assignee: Sumida Components & Modules GmbH, Obernzell (DE)

( * ) Notice: Subject to any disclaimer, the term of this patent is extended or adjusted under 35 U.S.C. 154(b) by 129 days.

(21) Appl. No.: 14/658,643

(22) Filed: Mar. 16, 2015

(65) Prior Publication Data

US 2015/0270051 A1 Sep. 24, 2015

(30) Foreign Application Priority Data

Mar. 19, 2014 (DE) ..... 10 2014 205 044

(51) Int. Cl.
*H01F 27/24* (2006.01)
*H01F 7/06* (2006.01)
(Continued)

(52) U.S. Cl.
CPC ..... *H01F 27/255* (2013.01); *H01F 7/06* (2013.01); *H01F 27/24* (2013.01); *H01F 27/263* (2013.01);
(Continued)

(58) Field of Classification Search
CPC ..... H01F 7/06; H01F 27/00–27/30
(Continued)

(56) References Cited

U.S. PATENT DOCUMENTS 3,319,204 A 5/1967 Wearley
2006/0244561 A1 11/2006 Iwakura et al. ..... 336/212
(Continued)

FOREIGN PATENT DOCUMENTS

CN 1855322 11/2006
CN 101427329 5/2009
(Continued)

OTHER PUBLICATIONS

Chinese action dated Jul. 27, 2016 in corresponding Chinese application 201510121897.8, with English translation, nineteen pages, including an apparent search report.
(Continued)

*Primary Examiner* — Tuyen Nguyen
(74) *Attorney, Agent, or Firm* — Fattibene and Fattibene LLC; Paul A. Fattibene

(57) ABSTRACT

Core bodies which have an alignment structure and allow an alignment during the production of magnetic cores irrespective of production tolerances, in which the production tolerances are compensated. In illustrative embodiments a core body of ferromagnetic material comprises a crossbar having an aspect ratio of length to width greater than 1, and at least one core leg extending laterally away from the crossbar along an extension direction. An alignment recess is formed in a rear surface of the crossbar, which is arranged on a side of the crossbar opposite the core legs. A magnetic core is formed of core bodies, whereby at least one core body is provided with an alignment recess, and the core bodies are aligned relative to one another.

17 Claims, 4 Drawing Sheets

(51) Int. Cl.
*H01F 27/255* (2006.01)
*H01F 27/26* (2006.01)
*H01F 41/02* (2006.01)

(52) U.S. Cl.
CPC .... *H01F 41/0246* (2013.01); *Y10T 29/49075* (2015.01)

(58) Field of Classification Search
USPC ..... 336/212, 233–234; 29/602.1
See application file for complete search history.

(56) References Cited

U.S. PATENT DOCUMENTS

| | | | | |
|---|---|---|---|---|
| 2007/0261231 | A1 | 11/2007 | Bosley et al. | 29/604 |
| 2007/0262839 | A1 | 11/2007 | Bosley et al. | 335/297 |
| 2010/0141368 | A1 | 6/2010 | Iwakura et al. | 336/196 |

FOREIGN PATENT DOCUMENTS

| | | |
|---|---|---|
| DE | 16 87 229 U | 7/1956 |
| DE | 298 17 865 U1 | 3/2000 |
| GB | 1 104 016 | 2/1968 |
| JP | S 55 34664 | 3/1980 |
| JP | S 63 349214 | 4/1988 |
| JP | H 02 143511 | 6/1990 |
| JP | 2007 012891 | 1/2007 |
| JP | 2011 233595 | 11/2011 |
| WO | WO 2013/099622 | 7/2013 |

OTHER PUBLICATIONS

German search report dated Nov. 28, 2014 in corresponding German Application No. 10 2014 205 044.8.
European Search Report in the corresponding EPO application No. 141575321 dated Oct. 19, 2015, three pages.
Japanese action in corresponding application 2015-054785, three pages.

CORE BODY OF FERROMAGNETIC MATERIAL, MAGNETIC CORE FOR AN INDUCTIVE COMPONENT AND METHOD OF FORMING A MAGNETIC CORE

FIELD OF THE INVENTION

The present invention relates to a core body of a ferromagnetic material, to a magnetic core for an inductive component, formed of a corresponding core body, and to a method of forming a magnetic core. In particular, the invention relates to core bodies for the production of magnetic cores which can be used in choke coils or transformers.

BACKGROUND OF THE INVENTION

Transformers and choke coils are, in general, electrotechnical inductive components which are used, in different technical fields, in electric or electronic circuits. Although transformers and chokes have a similar structure their fields of application differ. Chokes are low-impedance coils for reducing high-frequency currents on electric lines and are used in the field of the power supply of electric and electronic devices, in power electronics and high-frequency engineering. Transformers generally serve to increase or reduce alternating voltages. Usually, the input terminals and output terminals of transformers are galvanically separated.

The requirements to be fulfilled by electronic and electric circuits in modern applications frequently necessitate a miniaturization, based on the desire for more compact designs of electric and electronic components, lower losses and maximum capacities, along with a simultaneous flexible adjustment to different voltage sources. It is desirable in many applications, for example, that the operation of electric and electronic circuits is independent of fluctuations in a supply voltage. Moreover, an increasing miniaturization of electric and electronic circuits is possible only if it is ensured that losses and tolerances are kept as low as possible, or are largely compensated, during the production of individual components of electric and electronic circuits. As far as inductive components are concerned, e.g chokes and transformers, this means that properties predetermined for these components, e.g. geometric dimensions, and physical properties, e.g. inductance, heat conduction and the like, are subject to as few tolerances as possible, respectively, deviate from desired physical properties to a smallest possible extent. For the production of inductive components this means that tolerances in the production of magnetic cores are reduced and compensated.

In general, in the fabrication of inductive components, the production of magnetic cores is accompanied by production-induced tolerances which cannot be avoided despite all optimization. For example, if core bodies formed of ferrite material are sintered, length tolerances of +/−2.5% have to be expected as ferrite material experiences thermally induced changes of length in sintering processes. Therefore, if a magnetic core is to be formed of individual core bodies, which are made of a sintered ferrite material, it cannot be precluded that assembled magnetic cores are subject to tolerances in the range of +/−2.5% per core body, resulting in a tolerance of +/−5% for a magnetic core formed of two core bodies.

The tolerances lead above all to problems on the connection surfaces, such that not only the inductive properties are affected, but also mechanical properties are changed, e.g. the mechanical stability of the magnetic core, as will be explained below. The length tolerances occurring in core bodies lead to offset sections on the contact faces of the used core bodies during the production of magnetic cores, preventing a flush coupling of the contact faces. FIG. 1 schematically illustrates, in a cross-sectional view not true to scale, a formation of a magnetic core according to a double E-core configuration consisting of two core bodies 1 and 3. The core body 1 has, in this figure, two side legs 11, 15 and one center leg 13. Core body 3 correspondingly has two side legs 31, 35 and one center leg 33. A tolerance-induced deviation in the widths of the legs 11, 31 of core bodies 1 and 3 is schematically shown by reference number V1 of FIG. 1.

For the two core bodies 1 and 3 to be glued together in a defined and reproducible manner, despite deviation V1 as shown, both core bodies 1, 3 are abutted against a stop face 5 during the gluing process to carry out a core alignment. As shown in FIG. 1, the offset between the legs of core bodies 1 and 3 increases, as is shown by offset V2 with respect to the center legs 33 and 13 and by offset V3 with respect to the side legs 35 and 15. Despite the alignment at an outer core surface of both side legs 11 and 31 by means of the stop surface 5, the offset increases with an increasing distance from the stop surface 5 (in the direction of the normal towards the stop face 5), as is shown in FIG. 1. Thus, the magnetic core correspondingly formed of core bodies 1 and 3 shows a very strong asymmetry in its legs. It is to be noted that the magnetically active cross-sectional area decreases on the contact faces of the legs of both core bodies 1 and 3 along the magnetic core to one side of the magnetic core. This results in different values for the magnetic resistance in the core legs (11, 31), (13, 33) and (15, 35) and undesired sources for leakage fluxes in the magnetic core, so that the inductance for the magnetic core formed from core bodies 1 and 3 uncontrollably changes and, in particular, deviates from a desired inductance. The offset in the core legs, and the associated misalignment of the legs, respectively, legs not connected in a flush manner at the connection surfaces, also lead to structurally weak points at these sites, which cause poor mechanical properties, make the magnetic core more prone to damages, and can entail problems in processes that follow the production of the magnetic core. Consequently, it is no longer possible to ensure an exact setting of desired properties for the inductive component to be produced.

Based on the problems described above it is, therefore, desirable to provide a core body, a magnetic core formed of core bodies, and a method for producing a magnetic core in which tolerances are compensated.

SUMMARY OF THE INVENTION

The objects and problems described above are solved by a core body which has an alignment structure and allows an alignment during the production of magnetic cores irrespective of production tolerances, in which the production tolerances are compensated. In particular for sintered core bodies the magnetic capacity of inductive components to be produced is thus not negatively influenced, despite sintering tolerances.

In one aspect of the present invention a core body of ferromagnetic material is provided. The core body comprises a crossbar having a length dimension and a width dimension, wherein a ratio of length dimension to width dimension is greater than 1 . The core body furthermore comprises at least one core leg which extends laterally away from the crossbar along an extension direction, wherein the extension direction is oriented perpendicular to the length dimension and the width dimension, and an alignment recess which is formed in a rear surface of the crossbar. The rear surface is, in this case, arranged on a side of the crossbar opposite the at least one core leg.

In an illustrative embodiment the alignment recess may be arranged at the centroid of the rear surface. Thus, an arrangement of the alignment recess on the core body is provided in a reproducible manner, which is independent of production tolerances and allows a symmetrical alignment of the core body.

In another illustrative embodiment the core body may furthermore comprise at least a second core leg in which the alignment recess is arranged, in the rear surface, centered relative to two core legs, the two core legs being arranged eccentrically with respect to the length dimension. Thus, a symmetrical alignment of the core body can be obtained if the core body has a C- or E-core configuration. A core offset caused by production tolerances can here be symmetrically distributed over a magnetic core to be produced and, consequently, deviations caused by production tolerances can thus already be minimized in the production.

In another illustrative embodiment the at least one core leg may be arranged centrally on the crossbar, perpendicular to the extension direction. Moreover, the alignment recess is arranged to be face-centered with respect to a cross-sectional area of the core leg oriented perpendicular to the extension direction. Thus, a symmetrical alignment of the core body with respect to the centrally arranged core leg can be obtained.

In another illustrative embodiment the alignment recess may have an alignment surface which, at least in certain areas, is formed according to a partial area of a hemisphere surface or a conical surface. Thus, it is possible to reduce leakage fluxes. A correspondingly configured alignment recess is furthermore advantageous to the effect that correspondingly configured alignment tools for aligning the core body may be used, whereby the risk of damaging the core body is reduced.

In another illustrative embodiment the alignment recess may include at least three planar alignment surfaces. By providing three planar alignment surfaces it is possible to define a special alignment orientation of the core body by a specific orientation of the alignment surfaces in the alignment recess. On this basis it can be ensured in automated alignment processes that the core body is arranged in a desired alignment orientation during the alignment process. For example, a tetrahedral alignment opening may be provided. Alternatively, cuboid-shaped alignment openings, pyramid-shaped alignment openings, or generally polyhedral alignment openings, respectively, combinations thereof may be provided so as to allow a reliable engagement with correspondingly configured alignment tools.

In another illustrative embodiment a width dimension of the alignment recess is less than 50% of the width dimension of the core body. A length dimension of the alignment recess is less than 50% of the length dimension of the core body. Thus, it is ensured that the alignment recess may allow for a two-dimensional alignment in an advantageous manner, i.e. an alignment along two independent directions in the rear surface of the crossbar, respectively, parallel thereto.

In another illustrative embodiment a depth extension of the alignment recess into the core body is less than 50% of a height dimension of the crossbar, which is oriented parallel to the extension direction. This represents an advantageous measure to prevent a negative influence of the alignment recess on the magnetic flux in the crossbar.

In another illustrative embodiment the core body is formed of a sintered ferrite material. Thus, production tolerances in magnetic cores formed of sintered core bodies are advantageously compensated.

In another aspect of the present invention a magnetic core for an inductive component is provided. The magnetic core comprises a first core body of ferromagnetic material according to the first aspect, and a second core body of ferromagnetic material which comprises a second crossbar having a length dimension and a width dimension, and at least one core leg extending laterally away from the crossbar along the extension direction. A ratio of length dimension to width dimension is, in this case, greater than 1 . The first and second core bodies are connected by means of the core legs. Thus, magnetic cores are provided to include a first core body, which can be aligned by means of the alignment recess, along with an advantageous compensation of production tolerances. Magnetic cores according to this aspect may have, for example, a H- or Cl- or El- or EE-core configuration.

In an illustrative embodiment herein both core bodies of the magnetic core may each have an alignment recess. Thus, an advantageous alignment of both core bodies relative to one another can be obtained.

In a third aspect of the present invention a method of forming a magnetic core is provided. The method comprises providing a powder of ferromagnetic material, pressing of a ferromagnetic material filled into a die for producing a pressed blank, sintering the pressed blank to form a first sintered core body, aligning the first sintered core body relative to a second core body, and subsequently connecting the first sintered core body to the second core body. The pressed blank formed in the pressing process comprises a crossbar having a length dimension and a width dimension, at least one core leg extending laterally away of the crossbar, away therefrom, along an extension direction, and an alignment recess. A ratio of length dimension to width dimension is, in this case, greater than 1 . The die furthermore has a structure which produces the alignment recess in the pressed blank. The alignment of the sintered core body relative to the second core body is accomplished by an alignment device having an engagement element that is engaged with the alignment recess of the sintered core body prior to the alignment, wherein the alignment is carried out along the length and width dimensions. Consequently, it is possible to align the core bodies relative to one another prior to connecting the core bodies so as to symmetrically distribute, respectively, compensate a tolerance-induced core offset between the core bodies.

In an illustrative embodiment the engagement element comprises at least one catch face and/or catch edge so as to engage with the alignment recess.

In another illustrative embodiment the second core body is another sintered core body and includes another alignment recess with which another engagement element of the alignment device engages during the alignment.

In another illustrative embodiment both core bodies each comprise a crossbar and a core leg centrally arranged on the respective crossbar, and the centrally arranged core legs are aligned symmetrically to one another. Thus, it is possible to obtain a symmetrical distribution of a core offset over the magnetic core in an easy manner.

BRIEF DESCRIPTION OF THE DRAWINGS

Exemplary embodiments of the present invention according to different aspects will be described with reference to the accompanying figures below.

DETAILED DESCRIPTION OF THE PREFERRED EMBODIMENTS

Different illustrative embodiments of the present invention according to their different aspects with respect to the accompanying figures will be described in greater detail in the description below.

Figure 1:
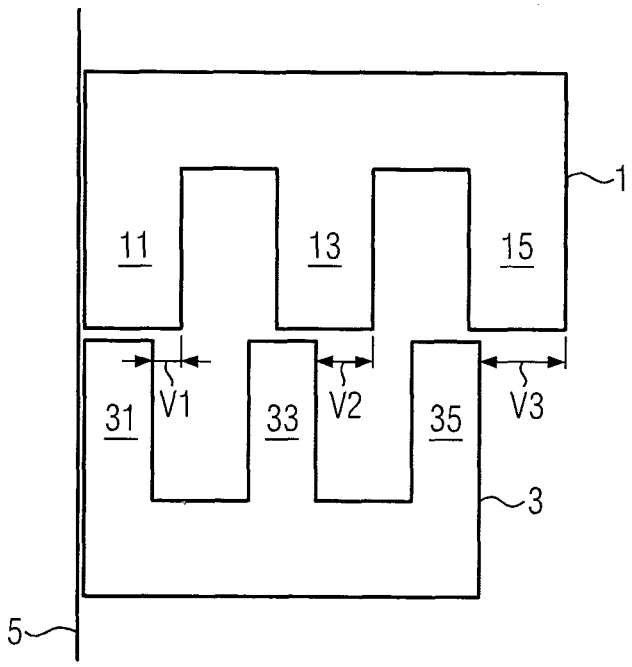
FIG. 1 (Prior Art)
FIG. 1 schematically shows the production of a known magnetic core in an EE-configuration with production tolerances.
Figure 2A:
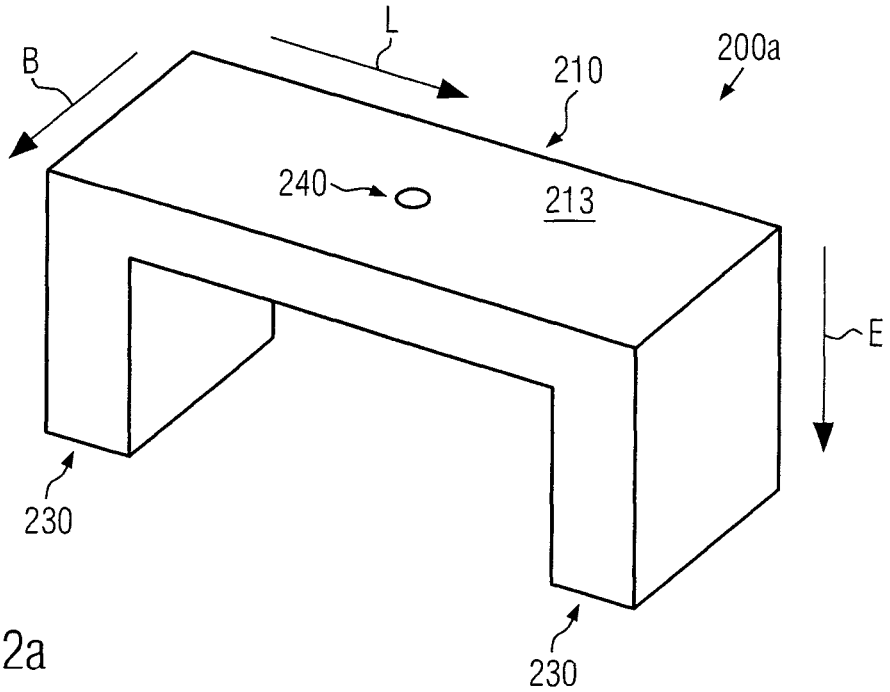
FIG. 2*a* schematically shows a C-core body in a perspective view according to a illustrative embodiment of the present invention.

FIG. 2*a* represents a core body 200*a* according to some illustrative embodiments of the present invention. The core body 200*a* comprises a crossbar 210 having a length dimension L and a width dimension B, which are defined along corresponding length and width directions. An aspect ratio defined by a ratio of length dimension L to width dimension B is greater than 1. Exemplary aspect ratios may be 1.1 or more, 1.5 or more, 2 or more, or at least 5.

Perpendicular to directions parallel to the dimensions L and B an extension direction E is defined. Two side legs 230 extend away from the crossbar 210 along extension direction E. On a side of the crossbar 210 opposite the side legs 230 along the extension direction E a rear surface 213 of the crossbar 210 is arranged. Furthermore, an alignment recess 240 is formed in the rear surface 213. In some illustrative embodiments the alignment recess 240 in the rear surface 213 of the crossbar 210 may have a circular or elliptical edge, as is shown in FIG. 2*a*. Alternatively, the alignment recess 240 may be formed by a polyhedral cavity. In other words, an edge of the alignment recess 240 formed in the rear surface 213 of the crossbar 210 may have the shape of a polygon.

In some illustrative embodiments the alignment recess 240 is arranged at a centroid of the rear surface 213. With respect to length dimension L and width dimension B this allows a symmetrical alignment of the core body 200*a* during the alignment process. The alignment process will be described below. Additionally or alternatively, the alignment recess 240 may be arranged centrally relative to the side legs along the length dimension L. In other words, the alignment recess 240 may be arranged along the length dimension L in the rear surface 213 such that a distance measured along the length dimension L to one of the side legs 230 is equal to a distance to the other side leg 230 measured in the opposite direction along the length dimension L. By means of the alignment recess 240 it is thus possible to carry out an alignment in an alignment process which is symmetrical with respect to the side legs 230.

In some illustrative embodiments herein the alignment recess 240 is dimensioned such that a length dimension of the recess 240 along the length dimension L of the crossbar is less than 50% of the length dimension of the crossbar, whereas a width dimension of the alignment recess 240 along the width dimension B is less than 50% of the width dimension B of the crossbar 210. For example, a width dimension of the alignment recess and/or a length dimension of the alignment recess may be 50% or less of the length dimension L and/or the width dimension B of the crossbar 210. In some specific illustrative examples a length dimension of the alignment recess 240 and/or a width dimension of the alignment recess 240 may be at most 15% or at most 5% of the length dimension L and/or the width dimension B of the crossbar 210. In another explicit example a length dimension of the alignment recess 240 and/or a width dimension of the alignment recess 240 is at most 10% or at most 1% of the length dimension L and/or the width dimension B of the crossbar 210. In these illustrative embodiments an alignment of the core body 200*a* by means of the alignment recess 240 may be carried out with an accuracy that is dependent on the dimensions of the alignment recess.

In some illustrative embodiments the alignment recess 240 has a depth extension from the rear surface 213 into the material of the crossbar 210 which, measured along the extension direction E from the rear surface 213 into the material of the crossbar 210, is at most 50% or less of a height dimension of the crossbar, measured outside the side legs 230 along direction E. In some specific embodiments the depth extension is, for example, at most 20% or at most 5%. In some specific illustrative examples herein the depth direction of the alignment recess may be approximately at most 2%, or even only at most 1% of the height dimension of the crossbar. Thus, it is possible to suppress impacts of a leakage field caused by the alignment recess 240.

It is to be noted that the alignment recess 240 is altogether dimensioned such that an impact of a leakage field caused by the alignment recess 240 hardly influences (in terms of measuring accuracy) the magnetic properties of the core body 200*a*. In particular, in measurements of core bodies according to the invention, as opposed to comparative core bodies without correspondingly formed alignment recesses, possible variations in the inductive behavior of the core body, caused by the alignment recess, are less than 5% or even less than 1%.

Figure 2B:
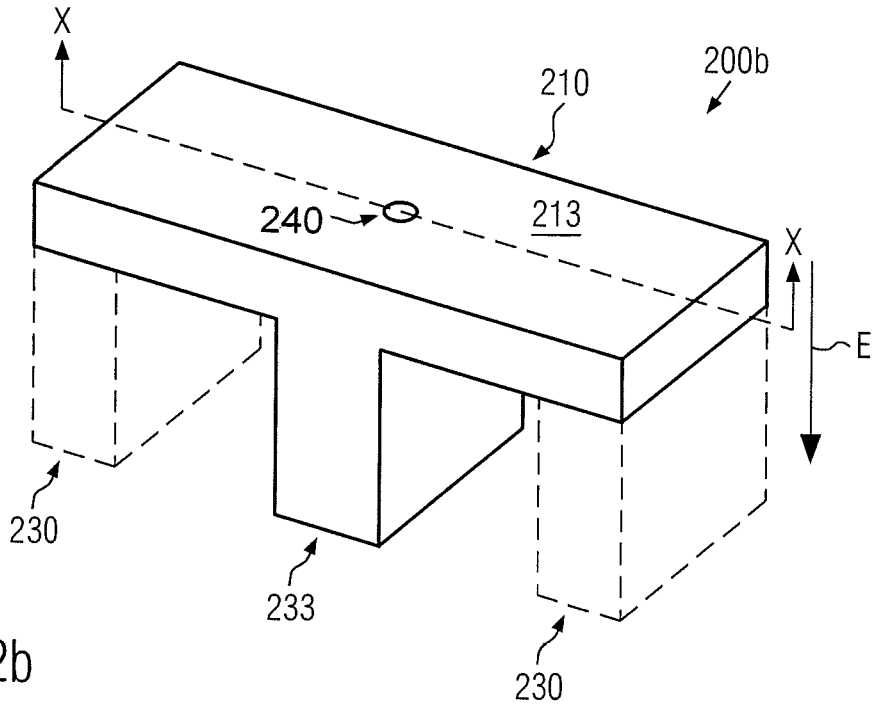
FIG. 2*b* schematically shows an E-core body according to another illustrative embodiment of the present invention.

Alternative illustrative embodiments are described by means of FIG. 2*b*. FIG. 2*b* shows a core body 200*b* having an E- or T-core configuration, comprising optional side legs 230 that extend away from the crossbar 210 (cf. crossbar 210 in FIG. 2*a*), on a rear surface 213 of the crossbar 210 with regard to the extension direction E, and are arranged on opposite sides, and a center leg 233. The core body shown in FIG. 2*b* differs from the core body 200*a* described by means of FIG. 2*a*, apart from the side legs 230 which are deemed to be optional, by the center leg 233.

According to illustrative embodiments the center leg 233 is arranged centrally with respect to the length dimension of the crossbar 210 (cf. FIG. 2*a*). This means that distances from the center leg to the optional side legs 230, respectively, the correspondingly opposite sides of the crossbar are each equal in size.

It is to be noted that the side legs 230 represent optional structures of the core body 200*b*, as is suggested by the dashed lines in FIG. 2. In particular, according to some illustrative embodiments, the core body 200*b* merely includes the center leg 233, and the core body 200*b* is configured according to a T-configuration. Alternatively, in other illustrative embodiments of the core body 200*b*, at least one side leg 230 and the center leg 233 are provided.

In some illustrative embodiments the alignment recess 240 is arranged to be face-centered with respect to a cross-sectional area of the core leg oriented perpendicular to the extension direction. Thus, an alignment of the core body 200*b* symmetrical with respect to the center leg 233 can be carried out.

Figure 2C:
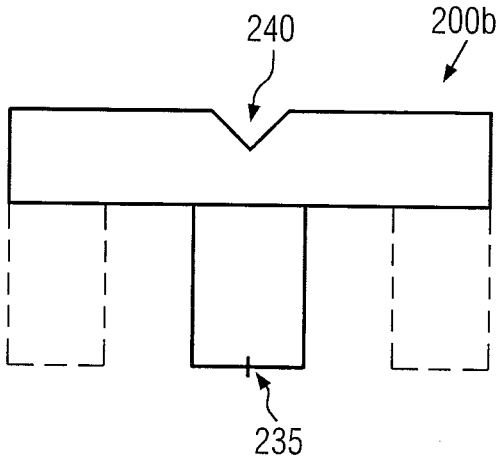
FIG. 2*c* schematically shows the E-core body illustrated in FIG. 2*b* in a cross-sectional view.

FIG. 2*c* schematically shows a cross-sectional view along line X-X of the perspective view of the core body 200*b* in FIG. 2*b*. A center of the cross-sectional area of the center leg 233 is designated with reference number 235 in FIG. 2*c*. It can be seen that the alignment recess 240 is arranged in alignment relative to the center 235. Optional side legs are shown by dashed lines.

As shown in FIG. 2*c*, the alignment recess 240 may have planar alignment surfaces. In the embodiment illustrated in FIG. 2*c* the alignment recess 240 may be configured as a wedge-shaped cavity. In some illustrative embodiments the alignment recess 240 may be provided by a wedge-shaped cavity. Alternatively, the alignment recess 240 may have a tetrahedral configuration. It is to be noted that a cavity having the shape of a tetrahedron may characterize a specific orientation of the core body 200*b*. For example, an edge triangle formed by a tetrahedral cavity may be oriented in the rear surface 213 such that the triangle points of the edge triangle point in specific directions. Other alternative embodiments of the alignment recess will be described below with reference to FIGS. 4*a* and 4*b*.

Figure 3:
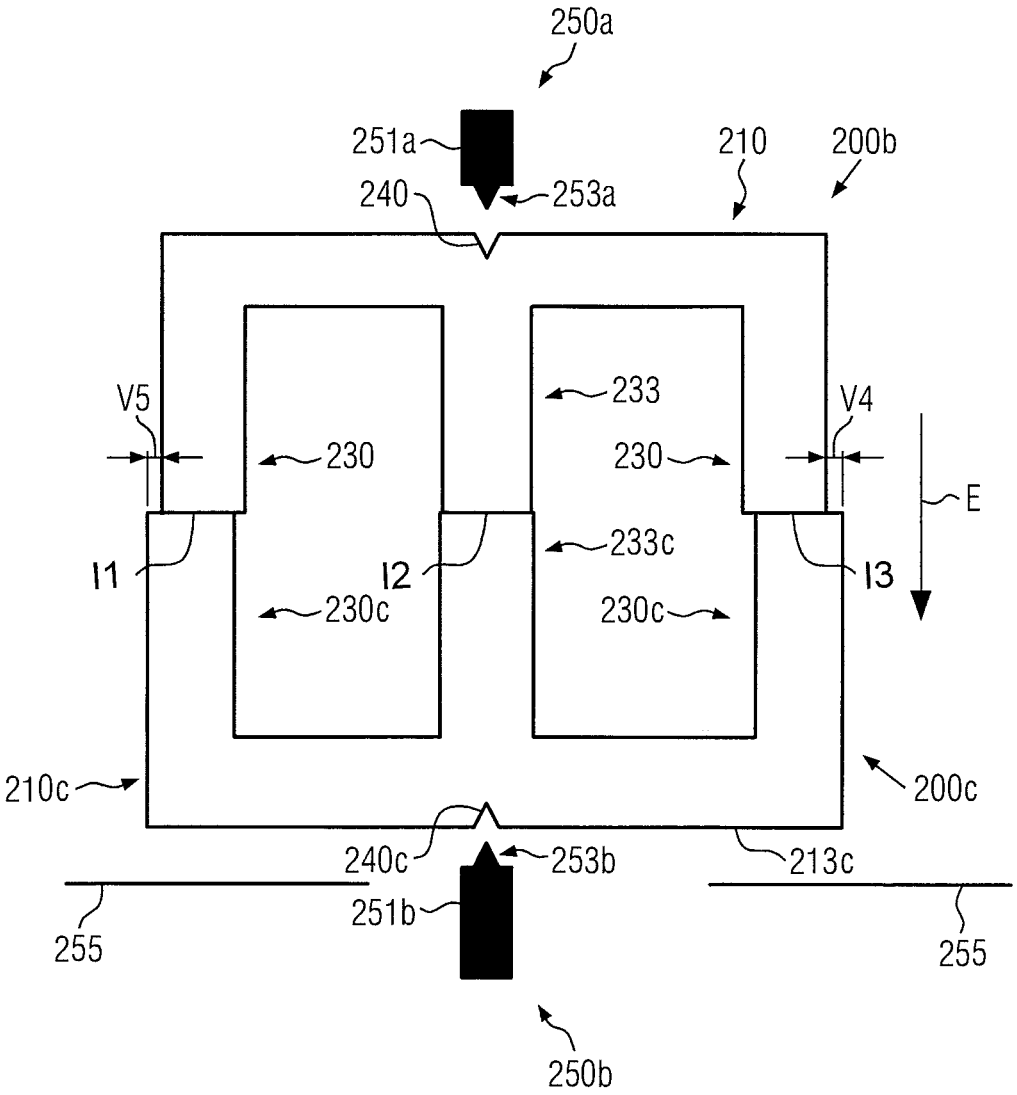
FIG. 3 schematically shows aligning two core bodies according to illustrative embodiments of the present invention.

FIG. 3 graphically shows an alignment of two core bodies 200*b* and 200*c* according to some illustrative embodiments of the present invention. Although the core bodies 200*b* and 200*c* have an E-configuration, it will be appreciated that this is not a limitation of the present description. Alternatively, core bodies having T-, C-, I-and E-configurations can be combined with one another and in different combinations. With regard to the illustration in FIG. 3 it is furthermore to be noted that the cores 200*b* and 200*c* may be understood as lying next to one another or on top of one another with respect to a direction characterized by gravity.

As illustrated, the core body 200*b* is configured in correspondence with core body 200*b* illustrated in FIGS. 2*b* and 2*c* and described in this regard.

As illustrated, the design of core body 200*c* is similar to that of core body 200*b*, with side legs 230*c* and a center leg 233*c* extending away from a crossbar 210*c* of the core body 200*c* in the extension direction E. An alignment recess 240*c* is formed on a rear surface 213*c* of the crossbar 210*c* arranged opposite the core legs 230*c*, 233*c*.

The core bodies 200*b* and 200*c* are placed against one another such that the core legs 230, 233 and 230*c*, 233*c* point to one another and contact one another on contact faces I1, I2 and I3. It is to be noted that, for connecting the core bodies 200*b* and 200*c*, the contact faces I1, I2 and I3 may be treated with a joining agent, e.g. an adhesive or the like, so as to achieve a permanent connection of the core bodies 200*b* and 200*c* to form a magnetic core. Due to production tolerances ensuing from the production of the core bodies 200*b* and 200*c* the legs 230 and 230*c*, 233 and 233*c* cannot be aligned relative to one another without a core offset.

The core bodies 200*b* and 200*c* can be aligned relative to one another using an alignment device having engagement elements 250*a* and 250*b*, allowing a core offset to be symmetrically distributed over the magnetic core, so that a right-sided core offsets V4 and a left-sided core offset V5 between the respective side legs 230 and 230*c* are compensated, in particular have equal dimensions and, at the same time, are minimal. This entails that the magnetically effective core cross-section on the side legs, as represented by contact faces I1 and I3, is symmetrical and, despite core offset V4 and V5, maximal. By the alignment of the core bodies 200*b* and 200*c* relative to one another by means of the engagement elements 250*a* and 250*b* engaging with the corresponding alignment recesses 240 and 240*c* the center legs 233 and 233*c* of the core bodies 200*b* and 200*c* are aligned such that the contact faces of the center legs 233, 233*c* contact one another symmetrically and flush, in particular that an active cross-sectional area of the assembled center leg becomes smaller than a smallest cross-sectional area from the cross-sectional areas of the two center legs 233, 233*c*. Due to the adjusted contact face I2 the cross-sectional areas of the center legs 233*c* and 233, being magnetically effective cross-sectional areas, may be fully interpenetrated by the magnetic flux, and the magnetic flux is guided with a very low leakage in the center leg of the produced magnetic core, despite production tolerances.

In some illustrative embodiments the core bodies 200*b* and 200*c* are aligned through alignment recesses 240 and 240*c*, which are arranged centrally with respect to the respective center legs 233 and 233*c*, until the alignment recesses 240 and 240*c* are arranged exactly opposite one another along the extension direction E and, consequently, the alignment recesses 240 and 240*c* are adjusted along the extension direction E. Accordingly, a symmetrical alignment of the center legs 233 and 233*c* relative to one another is adapted.

Additionally or alternatively, an alignment of the core bodies 200*b* and 200*c* symmetrical with respect to the crossbars 210 and 210*c* can be obtained by alignment recesses 240 and 240*c* arranged in centroids of the rear surfaces 213 and 213*c*. Additionally or alternatively, an alignment of the core bodies 200*b* and 200*c* symmetrical to one another with respect to the side legs 230 and 230*c* can be obtained by alignment recesses 240 and 240*c* which are arranged centrally, perpendicular to the extension direction along the length dimensions of the core bodies 200*b* and 200*c*.

According to some illustrative embodiments of the present invention the alignment device comprises engagement elements 250*a* and 250*b* which are configured as catch pins 251*a* and 251*b*, with corresponding projections 253*a* and 253*b* being formed in a surface of the catch pins 251*a* and 251*b* which are configured to engage with the corresponding alignment recesses 240 and 240*c*. To this end, the projections 253*a* and 253*b* include catch faces and/or catch edges which are engaged with inner faces and/or edges of the alignment recesses 240 and 240*c*. For example, the projections 253*a* and 253*b* may be configured as a corresponding negative of the alignment recess 240 an 240*c*. In this case, the catch faces of the projections 253*a* and 253*b*, when engaged with alignment recess 240, 240*c*, rest against the inner surfaces of the alignment recess 240, 240*c* in a flush manner. Thus, by a guided positioning of the engagement elements 250*a* and 250*b* by the catch pins 251*a* and 251*b* engaging with the corresponding alignment recesses 240 and 240*c*, it is possible to achieve an alignment of the core bodies 200*b* and 200*c* relative to one another in the manner explained above.

According to some illustrative embodiments the alignment device may furthermore include a stop face 255 by means of which an alignment along the extension direction is realized. To this end, the stop face 255 may be positionable along the extension direction.

In some illustrative embodiments the alignment device according to the invention is provided as part of a gluing device for gluing core bodies together.

With regard to FIGS. 4*a* and 4*b* additional illustrative embodiments of the alignment device and the alignment recess will be described below.

Figure 4A:
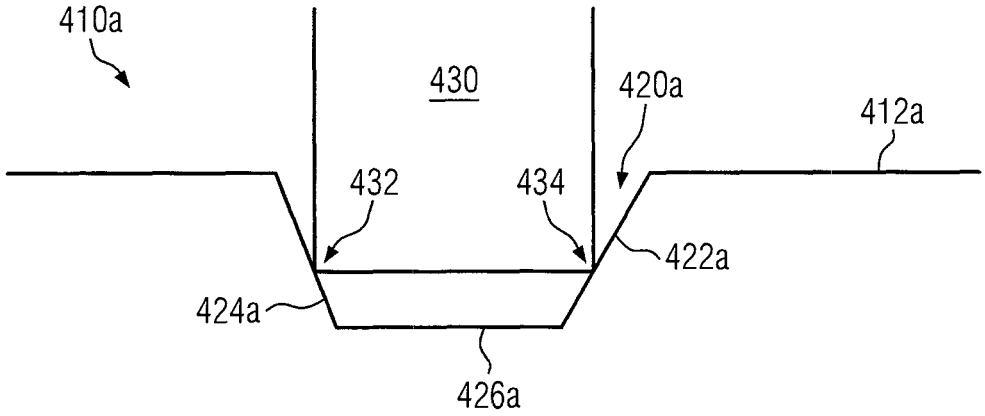
FIG. 4*a* schematically shows an alignment recess and an engagement element according to some illustrative embodiments of the present invention in a cross-sectional view.

FIG. 4*a* schematically shows, in a cross-sectional view, an enlarged section of an alignment recess 420*a* with which an engagement element 430 is engaged. The alignment recess 420*a* includes alignment surfaces 422*a*, 424*a* and 426*a*. The alignment recess 420*a* could be, for example, frusto-conical or pyramid-shaped. In specific examples, the illustrated alignment surfaces 422*a* and 424*a* are rotationally symmetrical and represent, for example, the circumferential surface of a cone. If the configuration is pyramid-shaped, the alignment surfaces 422*a* and 424*a* represent plane surfaces which are oriented with an inclination towards one another.

As illustrated, the engagement element 430 includes catch edges 432 and 434 which, when the engagement element 430 is engaged with the alignment recess 420*a*, are in contact with the corresponding alignment surfaces 422*a* and 424*a*. To support the engagement of the engagement element 430 with the alignment recess 420*a* alignment grooves (not shown) may be formed in the alignment surfaces 422*a* and 424*a*, into which an elastic material may optionally be filled so as to avoid damage to the alignment surfaces 422*a* and 424*a* by the catch edges 432 and 434, or damage to the catch edges 432, 434 during the alignment process. As an alternative to the explicitly illustrated engagement element 430 catch faces configured by flattening the edges (not shown) may be provided instead of the catch edges 432 and 434. Moreover, the engagement element shown in FIG. 4*a* may include a stop face (not shown) which prevents an excessive penetration of the engagement element 430 into the alignment recess 420, respectively, defines a penetration depth of the engagement element 430 into the alignment recess 420*a*.

Figure 4B:
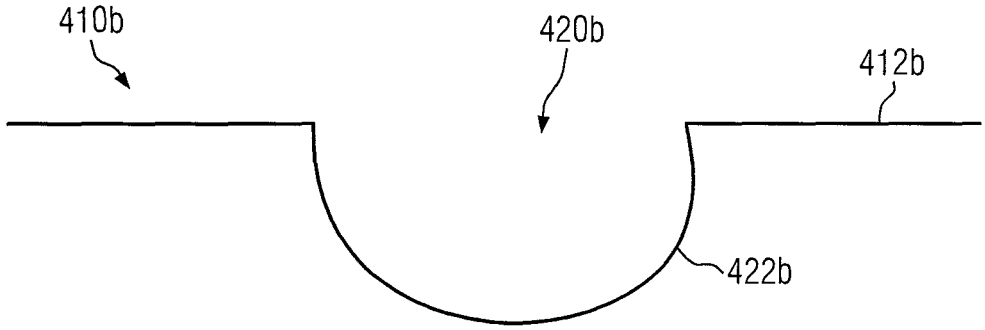
FIG. 4*b* schematically shows an alignment recess according to other illustrative embodiments of the present invention in a cross-sectional view.

FIG. 4*b* shows another illustrative embodiment of an alignment recess 420*b* provided in a rear surface 412*b* of a crossbar 410*b*. The alignment recess 420*b* includes an inner surface 422*b*, as alignment surface, which is configured according to an area of a hemisphere surface. A correspondingly configured engagement element may engage with the illustrated alignment recess 420*b*, whereby the alignment surface 422*b*, which is, at least in certain areas, of a hemisphere surface type, can advantageously avoid damage to the rear surface 412*b*. Alternatively, the alignment recess 420*b* may have a cylindrical configuration, whereby an alignment surface, which is, at least in certain areas, of a hemisphere surface type, may furthermore be provided in the bottom of a cylindrical alignment recess.

The alignment recess generally permits a two-dimensional positioning of the core body and represents, for example, a cavity correspondingly formed in the rear surface of the core body, which is dimensioned such that a two-dimensional positioning of the core body can be carried out by means of an alignment device engaging with the alignment recess.

Core bodies according to the embodiments described above can, in some illustrative embodiments, be formed by providing a powder of a ferromagnetic material. In exemplary embodiments the ferromagnetic material is a ferrite material. Additionally or alternatively, a superparamagnetic material may be provided.

In a subsequent production step the provided powder is filled into a die and pressed, so as to obtain a pressed blank. The die is configured as a negative of the core body to be produced and, in particular, has a structure to define an alignment recess, e.g. a projection or stud formed in the die. Alternatively, after the pressing process, an alignment recess may be formed in the pressed blank by means of a suited tool.

Upon producing the pressed blank, the pressed blank is exposed to a sintering process in a next production step, so as to form a sintered core body from the pressed blank. In some illustrative embodiments an alignment recess may be formed in the sintered core body using a suited tool, provided the alignment recess was not already formed before.

In a subsequent alignment process, which constitutes a next production step, the sintered core body is aligned relative to a second core body, which may have a similar configuration, by means of an alignment device as described above.

Upon the alignment process the aligned, sintered core bodies are connected to one another in a next production step, so as to produce a magnetic core.

Summarizing, the present invention provides core bodies which have an alignment structure, to allow, in the production of magnetic cores, an alignment irrespective of production tolerances, during which alignment the production tolerances are compensated. In illustrative embodiments a core body made of a ferromagnetic material comprises a crossbar with an aspect ratio of length to width greater than 1, and at least one core leg extending laterally away from the crossbar along an extension direction. Moreover, an alignment recess is formed in a rear surface of the crossbar, which is arranged on a side of the crossbar opposite the core legs. A magnetic core is formed of core bodies, whereby at least one core body is provided with an alignment recess, and the core bodies are aligned relative to one another.

What is claimed is:

1. Method of forming a magnetic core, comprising:

providing a powder of ferromagnetic material;

pressing of a ferromagnetic material filled into a die for producing a pressed blank, the pressed blank comprising:

a crossbar having a length dimension and a width dimension, wherein a ratio of length dimension to width dimension is greater than 1, at least one core leg which extends laterally of the crossbar, away therefrom, along an extension direction, and an alignment recess, and wherein the die has a structure which produces the alignment recess;

sintering the pressed blank for forming a sintered core body;

aligning the sintered core body relative to a second core body by means of an alignment device having an engagement element that is engaged with the alignment recess of the sintered core body prior to the alignment, wherein the alignment is carried out along directions along the length and width dimensions; and subsequently connecting the sintered core body to the second core body to form the magnetic core.

2. Method according to claim 1, wherein the engagement element comprises at least one catch face and/or catch edge so as to engage with the alignment recess.

3. Method according to claim 1, wherein the second core body is another sintered core body and comprises another alignment recess with which another engagement element of the alignment device engages during the alignment.

4. Method according to claim 1, wherein both core bodies each comprise a crossbar and a core leg centrally arranged on the respective crossbar, and the centrally arranged core legs are aligned symmetrically to one another.

5. The method according to claim 1, wherein:

the alignment recess is formed in a rear surface of the crossbar, which is arranged on a side of the crossbar opposite the core legs.

6. The method according to claim 5, wherein the alignment recess is arranged at the centroid of the rear surface.

7. The method according to claim 5, wherein the core body furthermore comprises at least a second core leg, and the alignment recess is arranged, in the rear surface, centered relative to two core legs, the two core legs being arranged eccentrically with respect to the length dimension.

8. The method according to claim 5, wherein the core leg is arranged centrally on the crossbar, perpendicular to the extension direction, and the alignment recess is arranged to be face-centered with respect to a cross-sectional area of the core leg oriented perpendicular to the extension direction.

9. The method according to claim 5, wherein the alignment recess has an alignment surface which is formed at least according to a partial area of a hemisphere surface.

10. The method according to claim 5, wherein the alignment recess has an alignment surface which is formed at least according to a partial area of a conical surface.

11. The method according to claim 5, wherein the alignment recess includes at least three planar alignment surfaces.

12. The method according to claim 5, wherein a width dimension of the alignment recess is less than 50% of the width dimension of the crossbar, and a length dimension of the alignment recess is less than 50% of the length dimension of the crossbar.

13. The method according to claim 5, wherein a depth extension of the alignment recess into the core body is less than 50% of a height dimension of the crossbar, which is oriented parallel to the extension direction.

14. The method according to claim 5, wherein the core body is formed of a sintered ferrite material.

15. An alignment device for performing the method according to claim 1, the alignment device comprising:

engagement elements which are configured as catch pins, the catch pins being configured to engage with respective alignment recesses of a core body.

16. A gluing device for gluing core bodies together when fabricating a magnetic core for an inductive component, the gluing device comprising an alignment device according to claim 15.

17. A method of forming a magnetic core comprising the steps of:

forming a first partial magnetic core having a first crossbar and a first leg extending from the first crossbar, said crossbar having a first alignment recess therein;

forming a second partial magnetic core having a second crossbar and a second leg extending from the second crossbar, said crossbar having a second alignment recess therein;

placing the first and second magnetic cores in an alignment device having a first and a second engagement element;

positioning the first engagement element within the first alignment recess in said first crossbar of said first partial magnetic core;

positioning the second engagement element within the second alignment recess in said second crossbar of second first partial magnetic core; and connecting the first partial magnetic core to the second partial magnetic core, whereby the magnetic core is formed and the first and second legs are aligned compensating for production tolerances.

* * * * *